United States Patent [19]

Kuwayama et al.

[11] 4,382,111

[45] May 3, 1983

[54] METHOD OF TREATING FIBER

[75] Inventors: Hirotsugu Kuwayama, Kusatsu; Hiroshi Ichikawa, Kisarazu, both of Japan

[73] Assignees: Meisei Chemical Works Co., Ltd., Kyoto; Idemitsu Kosan Company Limited, Tokyo, both of Japan

[21] Appl. No.: 260,691

[22] Filed: May 5, 1981

[30] Foreign Application Priority Data

| | | | |
|---|---|---|---|
| May 7, 1980 | [JP] | Japan | 55/59474 |
| Sep. 11, 1980 | [JP] | Japan | 55/125296 |
| Sep. 11, 1980 | [JP] | Japan | 55/125297 |
| Feb. 21, 1981 | [JP] | Japan | 56/23680 |
| Feb. 21, 1981 | [JP] | Japan | 56/23681 |

[51] Int. Cl.[3] ..... D02G 3/100

[52] U.S. Cl. ..... 428/375; 8/115.6; 252/8.6; 252/14; 427/255.6; 428/392; 428/393; 428/394; 428/395

[58] Field of Search ..... 427/255.6, 322, 323, 427/324, 444, 384, 392, 394, 389.9, 396; 585/1; 252/14, 49.6, 8.6; 8/471, 115.6; 264/130, 210.3; 428/375, 392, 393, 394, 395, 396

[56] References Cited

U.S. PATENT DOCUMENTS

| | | | |
|---|---|---|---|
| 2,101,532 | 12/1937 | Conquest | 252/8.6 |
| 2,158,374 | 5/1939 | Merrill | 252/8.6 |
| 3,632,291 | 1/1972 | Defago et al. | 8/471 |
| 4,049,374 | 9/1977 | Rejto | 8/471 |
| 4,062,644 | 12/1977 | Sponaes et al. | 8/471 |
| 4,256,459 | 3/1981 | Russell et al. | 8/471 |
| 4,306,874 | 12/1981 | Tappe et al. | 8/471 |

OTHER PUBLICATIONS

Hawley, "The Condensed Chemical Dictionary", Reinhold Company, p. 16, 1971.

Kirk-Othmer, "Encyclopedia of Chemical Technology", vol. 4, p. 57, 1964.

*Primary Examiner*—Sadie L. Childs

*Attorney, Agent, or Firm*—Frishauf, Holtz, Goodman & Woodward

[57] ABSTRACT

A method for imparting lubricity to fibers and masses of fibers such as yarn by applying a sublimable lubricating substance to said fibers in an amount sufficient to impart lubricity to said fibers. The preferred sublimable compounds are endo-trimethylenenorbornane, trimethylnorbornane, cyclododecane, adamantane and camphor. The invention also includes novel yarns containing an effective amount of a sublimable lubricating substance.

13 Claims, 1 Drawing Figure

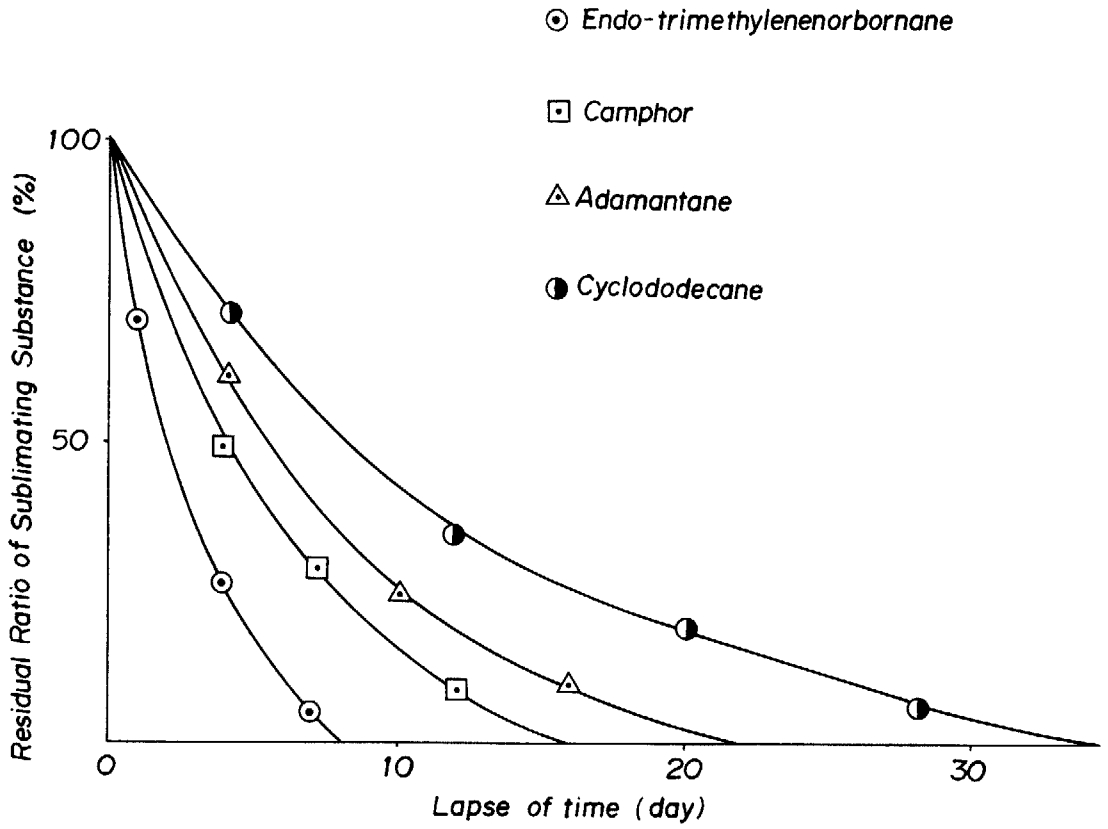
Endo-trimethylenenorbornane
Camphor
Adamantane
Cyclododecane
Residual Ratio of Sublimating Substance (%)
100
50
0
10
20
30
Lapse of time (day)

METHOD OF TREATING FIBER

BACKGROUND OF THE INVENTION

The present invention relates to a method of treating fiber. More particularly, it relates to a method of treating fiber which comprises attaching a sublimable substance onto the fiber to increase the smoothness (or lubricity) and secondary processability thereof and furthermore to a method of treating fiber wherein the provision of smoothness (or lubricity) to fiber and a water-repellent, oil-repellent and stain-inhibiting treatment are performed at the same time.

Heretofore, in knitting or weaving fibers, or forming webs of nonwoven fabrics to produce various fiber products, the fibers have been treated with an oily lubricant, such as solid paraffin, Japan wax, carnauba wax, spindle oil, silicone oil, etc.

For example, in the production of knitted fabrics, spun knitting yarns have been provided with smoothness prior to the knitting by rubbing the surface of the yarn with solid lubricants, such as solid paraffin, Japan wax, carnauba wax, etc. in order to reduce the friction resistance between the yarns and knitting needles, and between adjacent yarns. In accordance with this method of treating yarns, however, the oily lubricant cannot be uniformly adhered to the yarns. Therefore, the tension is large and uneven, and may result in stoppage of the knitting machine. Furthermore, this method of treating yarns has the disadvantage that since the lubricant is a solid material and the yarn surface is rubbed with such solid materials, the fluff of the yarns first attaches onto the lubricant and then onto the yarns, producing unevenness in the diameter of the yarns and finally providing knitted fabrics which are non-uniform. Additionally, much labor is required to replace the used lubricant with a new one owing to the consumption thereof and in watching the condition of attachment of the fluff, and the treatment efficiency is poor because the yarn treatment is performed on individual yarns.

With weaving yarns, sizing has been applied to prevent the formation of fluff during the course of weaving and to increase the strength of the yarn. This sizing, however, decreases the smoothness of the yarn. Therefore, owing to friction between the yarn and the knitting stick during weaving, fluff is formed even in warp. This formation of fluff decreases the shedding properties and lowers the yarn workability. Furthermore, fabrics of uniform quality cannot be obtained.

In order to eliminate the disadvantages described hereinbefore, weaving yarns have been treated with a lubricant prepared by emulsifying waxes with a surface active agent, or they have been coated with a silicone-based lubricant by spraying. The wax type lubricant suffers from the disadvantage that it is oxidized in air and difficulties are encountered in completely removing the oxidized product by post-treatment as with the silicone-based lubricant.

The thus-treated fibers are processed by knitting, weaving, formation of webs, etc. to provide fiber products. After the formation of such fiber products, the lubricant used in the preceding stage is useless. The lubricant should be removed by the use of caustic soda or a surface active agent. For this operation, additional steps and equipment are undesirably required. Even by application of such additional operations, it is impossible to completely remove the lubricant. The residual lubricant causes trouble at subsequent operations, such as post-dyeing, etc. and makes it difficult to obtain a fiber product of high quality. In various resin treatments, for example, water-repellency, oil-repellency and stain-inhibiting finishing using a fluoride compound, the presence of residual lubricant markedly reduces the finishing efficiency and causes various difficulties.

It is an object of the present invention to provide a method of treating fiber which imparts lubricity (or smoothness) uniformly to the fiber with high workability.

Another object of the present invention is to provide a method of treating fiber wherein provision of a lubricity treatment and a treatment to impart water-repellency, oil-repellency, and stain-inhibiting properties by the use of a fluorine compound are preformed at the same time.

SUMMARY OF THE INVENTION

The present invention provides a method of imparting lubricity to fibers by applying a sublimable substance to said fibers. There is no limitation to methods of applying the sublimable substance to the fibers. Examples of such processes include (1) a method of applying the sublimable substance by heating it or by placing it under reduced pressure so that it sublimes and condenses on the fibers; (2) a method of applying the sublimable substance by applying a solution of the sublimable substance in a solvent to the fibers; and (3) a method of applying the sublimable substance by applying an emulsion or dispersion of the sublimable substance on the fibers.

In another embodiment, the present invention provides a method of treating fibers with a solution, emulsion or dispersion of a sublimable substance together with a fluorine compound. By application of heating after the formation of fiber products, a water-repellent, oil-repellent and stain-inhibiting finish can be applied to the fiber products.

One of the features of the invention is that the sublimable substance used as a lubricant can be removed by the sublimation of said substance without the application of additional procedures after the formation of the fiber products by weaving, knitting and formation of webs, and that there is no problem of the sublimable substance as a lubricant remaining in the fibers. Thus, the sublimable substance of the invention exerts no adverse influence on finishing operations, such as dyeing and applying a fluorine compound finish.

The invention also provides individual fibers and masses of fibers and yarns impregnated with a sublimable substance.

BRIEF DESCRIPTION OF THE DRAWING

The FIGURE is a graph depicting decreases in the residual ratio of four sublimable substances in yarn over a period of time.

DETAILED DESCRIPTION OF THE INVENTION

Fibers generally can be used in the present invention. Examples of such fibers include natural fibers such as cotton, flax, hemp, jute, wool, silk, etc.; synthetic fibers such as polyester fibers, acrylic fibers, nylon fibers, polyvinyl alcohol fibers, polyvinyl chloride fibers, polypropylene fibers, etc.; semi-synthetic fibers such as rayon fibers, acetate fibers, etc.; inorganic fibers such as glass fibers, rock wool fibers and asbestos fibers, etc., and mixtures thereof.

The fibers are spun, woven or knitted, or webs of fibers are bonded together to produce textile materials. Examples of such textile materials include yarn, thread, knitted fabric, woven fabric, cut pile fabric, fiber vlees, fleece, pile nap, carpet, nonwoven fabric, felt, etc. These textile materials may have any desired form.

Sublimable substances used in the present invention are sublimable substances which can provide lubricity to a fiber when condensed on or otherwise deposited thereon or attached thereto. Examples of sublimable substances which can be used in the present invention include alicyclic compounds, such as endo-trimethylenenorbornane, trimethylnorbornane, cyclododecane, adamantane and camphor. These sublimable substances can be used alone or in combination with each other.

In providing lubricity to spun knitting yarn, the spun knitting yarn can usually be treated when they are wound on a cone or beam. The yarn wound on the cone or beam is placed in an appropriate pot or evaporation chamber wherein a sublimable substance is evaporated by heating or under reduced pressure and uniformly deposited (condensed) onto the yarns. The treating temperature is appropriately determined according to the type of the sublimable substance and the spun knitting yarn to be treated. It is preferred to maintain the pot or evaporation chamber under reduced pressure. One of the major features of the present invention is that steam-setting of the yarn can be performed at the same time by introducing hot water or steam into the pot or evaporation chamber together with the sublimable substance.

The present invention is not limited to the above described method. For example, a method in which prior to the cone-winding, yarn is passed through a room containing the sublimable substance in vapor form so that it condenses on the yarn, can be employed.

In the method of the present invention, the amount of the sublimable substance which is deposited is about 0.02 to 5% by weight, preferably about 0.03 to 3% by weight, based on the weight of the yarn. Th sublimable substance of the present invention attains the object of the present invention when using smaller amounts than when using the conventional wax. The amount of the sublimable substance to be deposited can be controlled by adjusting the time of contact between the yarn and vaporized sublimable substance, the treating temperature or the like.

For yarn on which the sublimable substance is uniformly deposited, the frictional resistance between the yarn and knitting needle at the time of knitting is reduced and, therefore, the sliding properties of the yarn are improved. Furthermore, the frictional resistance between adjacent yarns is reduced and, therefore, withdrawal of the yarn can be easily performed. Thus, the tension at the time of knitting is made uniform and knitting ability is improved. Furthermore, since there is no unevenness in the strength and diameter of the yarn, end breakage does not occur and knitted fabrics having uniform properties are prepared.

On the thus-obtained knitted fabrics, a small amount of the sublimable substance remains. The sublimable substance is not needed after the knitting and it should be removed. The sublimable substance can be removed merely by allowing the knitted fabrics to stand because of its sublimable properties. Thus, another feature of the present invention is that the prior art processing operation to remove lubricant can be omitted.

As described in detail, the present invention uses gas to apply the lubricant to fibers, which is different from the conventional methods wherein a solid lubricant is used. In accordance with the method of the present invention, therefore, large amounts of yarns, including yarns wound on a cone or beam can be treated at the same time and the sublimable substance can be uniformly deposited even in the interior of wound yarns. Furthermore, the method of the present invention is advantageous over the conventional methods in that the replacement of the lubricant, the observation of fluff, and the removal of the lubricant, are not necessary. The method of the present invention is a power-saving method which needs no additional apparatus and has excellent workability.

In another method to deposit a sublimable substance on fibers, a dispersion of the sublimable substance is used. This composition can be obtained usually as an emulsion composition by mixing and stirring a sublimable substance, a surfactant and water at a temperature higher than the melting point of the sublimable substance. When the temperature of the emulsion composition is lower than the melting point of the sublimable substance, it is converted into a suspension composition. The term "dispersion composition" as used herein includes both the emulsion composition and the suspension composition.

The dispersion composition of the sublimable substance for use in the present invention is generally produced by first heating to melt a mixture of a sublimable substance and a surfactant to obtain Composition (A) and then gradually adding Composition (A) while stirring to water maintained at a temperature higher than the melting point of the sublimable substance, although the present invention is not limited thereto. Additionally, depending on the state in which the dispersion composition of the sublimable substance is used, a method can be employed in which Composition (A) is first prepared and prior to the use of the dispersion composition, Composition (A) is introduced into hot water maintained at a temperature higher than the melting point of the sublimable substance and is allowed to be emulsified therein.

Although the dispersion composition of the sublimable substance for use in the present invention is, as described above, generally produced at a temperature higher than the melting point of the sublimable substance, it can be produced at a temperature lower than the melting point of the sublimable substance depending on the sublimable substance and surfactant which are used, the stirring conditions, the composition ratio, and so forth.

Any surfactant can be used to produce the dispersion composition of the sublimable substance. Examples of surfactants which can be used include anionic surfactants and nonionic surfactants. Suitable examples of anionic surfactants include carboxylic acid salts, such as sodium stearate; sulfuric acid ester salts, such as sodium lauryl-alcohol sulfate, sulfonic acid salts, such as sodium dodecylbenzene sulfonate; and phosphoric acid salts, such as higher alcohol-phosphoric acid ester salt. They can be used alone or in combination with each other. Suitable examples of nonionic surfactants include polyhydric alcohol esters such as stearic acid monoglyceride and sorbitan stearate; and polyethylene glycol type of surfactants, such as nonylphenyl polyethylene glycol ether and stearic acid polyethylene glycol ester.

The amount of the surfactant added is usually about 0.1 to 40 parts by weight and preferably about 0.5 to 20 parts by weight per 100 parts by weight of the sublimable substance.

The amount of the sublimable substance added is usually about 0.1 to 100 parts by weight and preferably about 0.2 to 30 parts by weight per 100 parts by weight of water.

For the dispersion composition of the sublimable substance for use in the present invention, when the grain size of the sublimable substance is about 1 micron or less, the dispersion is stable over a long period of time. Where the grain size is relatively large, a stabilizer may be added, if necessary. Examples of stabilizers which can be used include hydrophilic polymeric compounds, such as CMC, PVA, methyl cellulose, starch, casein, sodium alginate and proteins; water-soluble compounds, such as methanol and ethylene glycol; and inorganic gelatinizers, such as bentonite and fine powder of silicic acid. These stabilizers can be used alone or in combination with each other.

In the dispersion composition of the sublimable substance, fine particles of the sublimable substance are uniformly dispersed in water in any desired proportion. This makes easy handling of the sublimable substance as a fluid and prevents the sublimation of the sublimable substance during the storage even though it is in a fine particle form.

Spun yarns can usually be treated when they are wound on a cone or beam. Cone- or beam-wound yarns are placed in an appropriate pot or evaporation chamber wherein the sublimable substance is evaporated, by heating or treating under reduced pressure the dispersion composition and is uniformly deposited on the yarns. Prior to the introduction of the dispersion composition of the sublimable substance into the pot or evaporation chamber, it is usually mixed with water (hot water) in a tank-like or tubular mixer so that a predetermined concentration is attained. In this case, a fluid main component consisting substantially of the sublimable substance and the surfactant can be mixed with hot water. This method is advantageous in that it permits reducing the amount of the treating composition to be stored and to be transferred. The temperature and pressure for use in the treatment can be suitably determined depending on the type of the sublimable substance and yarns used.

In the treatment of the present invention, the steam-setting of yarns can be performed at the same time by introducing hot water or steam along with the dispersion composition of the sublimable substance.

The application of the sublimable substance to yarn according to the present invention is not limited to the embodiment as described above. For example, a method of treatment can be employed in which before the yarn is wound on a cone, the yarn is passed through a room wherein the sublimable substance is evaporated and then deposited on the yarn.

In the method of treatment of the present invention, the amount of the sublimable substance attached to or deposited on yarns is usually about 0.005 to 5% by weight and preferably about 0.01 to 2% by weight based on the weight of the yarn. Thus, the present invention is advantageous over the conventional methods using wax in that the effect of providing high lubricity can be obtained using the sublimable substance in smaller amounts than the amount of wax of the prior art. The amount of the sublimable substance to be deposited can be adjusted by controlling the amount of the dispersion composition of the sublimable substance to be introduced, the sublimable substance content, the time of contact between the yarns and the vapor of the sublimable substance, the temperature, and so forth.

In knitting, weaving, etc of the yarn with the sublimable substance deposited thereon, the frictional resistance between the yarn and the knitting needle or the like is reduced, and furthermore the frictional resistance between adjacent yarns is reduced. Therefore, the sliding property of the yarn is improved and the yarn can be smoothly drawn. This leads to uniformity in the tension of the yarns and improvement in the efficiency of operation or productivity. Furthermore, since there is no unevenness in the strength and diameter of the yarns, no end breakage occurs and thus knitted and woven fabrics having uniform properties can be obtained.

A small amount of the sublimable substance remains deposited on the knitted and woven fabrics, which should be removed because it is not needed after the knitting or weaving. The removal of the residual sublimable substance can be performed merely by allowing the knitted, woven or like fabrics to stand because the deposited material is sublimable. Thus, the present invention has an important feature that the step of removing the lubricant, which is essential for the conventional methods, can be omitted.

In another embodiment, the sublimable substance is used in an amount of about 0.1 to 5 parts by weight, preferably about 0.2 to 3 parts by weight, per 100 parts by weight of water. The amount of the surfactant to be added to the sublimable substance may be the same as described hereinbefore.

In accordance with this embodiment, the dispersion composition of the sublimable substance is brought in contact with yarn. For this contact treatment, a soaking method, a spraying method, a touch roll method, and a slit method can be used. The slit method as used herein means a contact treating method in which the yarns are passed while introducing the dispersion composition in the form of a liquid into a slit. In accordance with the soaking method and spraying method, the yarns can be treated in the state that they are wound on a cone or beam.

The sublimable substance deposited on the yarns by the contact treating method is then dried.

In this embodiment, the amount of the sublimable substance to be deposited on the yarns is usually about 0.005 to 5% by weight and preferably about 0.01 to 2% by weight. Thus, when using smaller amounts of the sublimable substance than the conventional wax, high lubricity can be imparted to the yarns. The amount of the sublimable substance to be deposited is adjusted by controlling the sublimable substance content of the aqueous dispersion composition, the method of contacting the yarns with the aqueous dispersion composition, the time of contact, and so forth.

It is to be noted that a fiber processing method comprising attaching a sublimable substance to fibers in accordance with the method as described above, producing a fabric product using the fibers with the sublimable substance attached thereto, and treating the fabric product with a fluorine compound is included in the scope of the present invention.

The sublimable substance is deposited on the fibers either by a method in which the sublimable substance is placed in an appropriate pot or evaporation chamber and evaporated by heating or placing it under reduced pressure, or by a method in which the sublimable substance is converted into any desired form, such as an emulsion, a suspension, a solution and an aerosol, by the usual procedure and then brought in contact with the fibers by techniques, such as coating and soaking. In preparing such emulsions, mixtures of water and various surfactants are generally used. As solvents for use in preparing such solutions, those exerting no adverse influences on the fibers are selected, for example, acetone, methyl ethyl ketone, ethyl acetate, diethyl ether, methylene chloride, methyl chloroform, trichloroethylene, tetrachloroethylene, trichlorotrifluoroethane, tetrachlorodifluoroethane, etc.

When the fibers with the sublimable substance uniformly deposited thereon are knitted or woven, the frictional resistance between adjacent fibers and between the fibers and the knitting needle or mechanical parts is reduced, and thus the desired fabric product can be efficiently produced.

Although a small amount of the sublimable substance remains deposited on the fiber product, when being allowed to stand, it dissipates over a period of time. Thus, the step of removing the residual lubricant, which is essential for the conventional methods, can be omitted. Furthermore, when the fibers are sent to the subsequent operations while still containing the sublimable substance and are processed therein, the sublimable substance is evaporated and removed.

The treatment of textile materials with a textile treating fluorine compound can be carried out by the usual technique. The fluorine compound is applied onto the textile materials by a soaking method, a padding method, a spraying method, a coating method or the like, and then is dried and heat-treated.

Examples of fluorine compounds which can be used are the fluoro-organic compounds including polymerized fluoro- and fluoro-chloro-hydrocarbons, e.g. homopolymers of tetrafluoroethylene, and perfluoro alkyl group-containing acrylate or methacrylate, copolymers of such monomers and alkyl acrylate, maleic anhydride, styrene, butadiene or the like, and fluorine resins, such as fluorine-containing urethane compounds. Although the amount of the fluorine compound used in not critical, it is usually used in an amount of about 0.1 to 50% by weight based on the weight of the textile material. The treating conditions are suitably determined according to the type of the fiber to be treated, the processing equipment, the performance to be required, and so forth.

The treatment to provide lubricity to fibers and the water-repellent, oil-repellent and stain-preventing treatment can be performed at the same time with the results substantially satisfactory for each treatment. That is, a solution or dispersion of the sublimable substance and the fluorine compound in a solvent is used to treat the fibers. It is to be noted that this embodiment is included within the scope of the present invention.

In preparing the solution or emulsion of the sublimable substance and the fluorine compound as used in the above treatment, the same solvents as described hereinbefore can be used. Alternately, they can be used in the form of a suspension which is prepared by dispersing in water, or in the form of an emulsion which is prepared by adding a surfactant. This solution or dispersion is applied to the fibers by techniques such as coating and soaking and deposited thereon. This treatment reduced the frictional resistance between the fibers, thereby permitting smooth sliding of the fibers, and thus the desired knitted fabrics, weaved fabrics, nonwoven fabrics, carpets, and the like can be prepared.

Upon heat-treatment of the thus-obtained textile materials, the deposited sublimable substance is evaporated and removed. At the same time, this heat-treatment converts the fluorine compound into a tough film layer, thereby providing excellent water-repellent, oil-repellent and stain-preventing properties to the textile materials. Thus, by using a processing solution containing therein both the sublimable and fluorine compound as in this embodiment, the process of processing the fibers can be greatly simplified and furthermore the efficiency of working can be significantly increased.

In accordance with the method of the present invention, the sublimable substance is applied as a lubricant in the form of a solution, a dispersion in water, or a gas and even used in a small amount, can be uniformly applied to fibers. Furthermore, in view of the sublimation property of the sublimable substance, the step of removing the lubricant can be omitted. Moreover, since there is no residual lubricant on the fibers, the treatment using the fluorine compound can be efficiently carried out, and thus textile materials having excellent water-repellent, oil-repellent and stain-preventing properties can be obtained.

Hereinafter, the present invention will be explained in greater detail by reference to the following examples. In these examples, the component ratio is by weight unless otherwise indicated. The water-repellency and oil-repellency were measured as follows:

Water Repellency

For knitted fabrics and woven fabrics, the water-repellency was measured by the spray method as defined in JIS L 1092-1977.

In the case of nonwoven fabrics and carpets, one drop of a 30% aqueous solution of isopropyl alcohol was dropped on a test piece and the time taken for the droplet to disappear was measured to determine the level of the water-repellency.

Oil Repellency

The oil-repellency was measured according to the method as defined in AATCC 118-1972.

One drop of each of the reagents shown in Table 1 below was gently dropped on the surface of a test piece which was spread horizontally, and the state of penetration of the reagent after 3 minutes was examined to determine the oil-repellency.

TABLE 1

| Rating | Reagent |
|---|---|
| 8 | n-heptane |
| 7 | n-octane |
| 6 | n-decane |
| 5 | n-dodecane |
| 4 | n-tetradecane |
| 3 | n-hexadecane |
| 2 | mixed solution of nujol (65)/ n-hexadecane (35) |
| 1 | nujol |
| 0 | Penetration is below Rating (1) |

EXAMPLE 1

Fourteen hundred grams of cotton spun knitting yarns (combed yarns 40/1) which had been wound on cones were placed in a can member of NICUM type steam setter testing machine (produced by Nikku Industry Co., Ltd.), and the pressure in the can member was reduced to 12 mmHg. Then, heated water maintained at 150° C. and 140 g of endo-trimethylenenorbornane maintained at 90° C. were injected into the can member, and the can member was maintained at 50° C. for 10 minutes to attach the endo-trimethylenenorbornane to the yarns. After cooling the can member, the yarns were taken out thereof. The amount of the endo-trimethylenenorbornane attached to the yarns and the tension of the thus-processed yarns at the time of running were measured. The results are shown in Table 2 comparing with the conventional wax-treated yarns.

The tension at the time of running for rewinding was measured under the following conditions:
Testing Machine: TENSTER-D
Running Rate of Test Piece: 200 m/min
Disc Tension: 30 g washer
Full Scale: 25 g

EXAMPLE 2

Fourteen hundred grams of polyester/cotton (50:50) mixed knitting yarns (40/1) were placed in the same can member as used in Example 1. The pressure of the can member was reduced to 12 mmHg. Then, 140 grams of adamantane maintained at 200° C. and heated water maintained at 150° C. were injected into the can member, and the can member was maintained at 70° C. for 10 minutes. After cooling the can member, the yarns were taken out. The amount of the adamantane attached to the yarns and the tension of the thus-processed yarns at the time of running were measured. The results are shown in Table 2.

EXAMPLE 3

One kilogram of polyacrylic spun knitting yarns (32/2) which had been wound on cones were placed in an atmospheric pressure-steam chamber, and 100 grams of camphor was placed on the bottom of the steam chamber. By heating the steam chamber from the outside thereof to 150° C., the camphor was sublimated. After cooling the steam chamber, the yarns were taken out. The amount of the camphor deposited on the yarns was 0.5% by weight. The tension of the yarn at the time of running was measured, and the results are shown in Table 2.

EXAMPLE 4

One kilogram of rayon staple spun knitting yarns (30/1) were placed in the same atmospheric pressure-steam chamber as used in Example 3, and 50 grams of cyclododecane was placed on the bottom of the steam chamber. By heating the steam chamber from the outside thereof to 200° C., the cyclododecane was sublimated and deposited on the yarns. The amount of the cyclododecane deposited on the yarns was 0.05% by weight. The tension of the thus-processed yarn at the time of running was measured, and the results are shown in Table 2.

TABLE 2

| Tension of Yarn at Running for Rewinding (gram) | Example | | | |
|---|---|---|---|---|
| | 1 | 2 | 3 | 4 |
| Yarn not processed | 12.7 | 11.2 | 15.2 | 10.6 |
| Yarn processed with Conventional Wax | 8.1 | 7.8 | 7.8 | 7.1 |
| (Amount deposited on yarn; % by weight) | (0.2) | (0.1) | (1.0) | (0.1) |
| Yarn processed by present invention | 2.5 | 3.5 | 4.9 | 5.1 |
| (Amount deposited on yarn; % by weight) | (0.2) | (0.1) | (0.5) | (0.05) |

Reference Example

In the same manner as in Example 1, endo-trimethylenenorbornane, adamantane, camphor, and cyclododecane were each attached to cotton spun knitting yarns (combed yarn 40/1). For each of the thus-processed yarns, the amount of the sublimating substance was 1.0% by weight. These processed yarns were allowed to stand in a room at 30° C. and changes in the amount of the sublimable substance deposited with a lapse of time were measured. The results are shown in the Figure.

EXAMPLE 5

Fourteen hundred grams of polyester/cotton (50:50) mixed knitting yarns (40/S) which had been wound on cones were placed in a can member as used in Example 1, and the pressure of the can member was reduced to 12 mmHg. Then, a dispersion composition of a sublimable substance (an emulsion composition comprising 2 grams of endo-trimethylenenorbornane, 1 gram of polyoxyethylene oleate, and 100 milliliters of heated water) was heated to 150° C. and injected into the can member along with heated water maintained at 150° C. Thus, the yarns were treated with the dispersion composition for 20 minutes while maintaining the temperature in the can member at 70° C. After cooling, the yarns were taken out of the can member.

The amount of the endo-trimethylenenorbornane deposited on the yarns and the tension of the thus-processed yarn at running were measured. The results are shown in Table 3 below.

TABLE 3

| | Tension of Yarn at Running for Rewinding (gram)*1 |
|---|---|
| Yarn not processed | 11.8 |
| Yarn processed with*2 Conventional Wax | 6.3 |
| (Amount deposited on yarn: % by weight) | (0.3) |
| Yarn processed by Present Invention | 2.8 |
| (Amount deposited on Yarn: % by weight) | (0.2) |

*1Conditions are same as described in Table 2.
*2Yarns withdrawn from a spinning machine were transferred from cops (wound on wooden tubes) to cones and wound thereon, and in the course of this operation, the yarns were passed over a mixed wax of paraffin and Japan wax.

EXAMPLE 6

Fourteen hundred grams of cotton spun knitting yarns (40/s) which had been wound on cones were placed in a can member as used in Example 1, and the pressure of the can member was reduced to 12 mmHg. Then, a dispersion composition of a sublimable substance (an emulsion composition comprising 2 grams of endo-trimethylenenorbornane, 1 gram of polyoxyethylene oleate and 100 ml of heated water) was heated to 150° C. and injected into the foregoing can member which had been evacuated, wherein the dispersion composition was evaporated. Thus, the yarns were treated with the dispersion composition for 10 minutes while maintaining the temperature of the can member at 60° C. After cooling, the yarns were taken out of the can member.

The amount of the endo-trimethylenenorbornane deposited on the yarns and the tension of the thus-processed yarn at running were measured, and the results are shown in Table 4 below.

TABLE 4

| | Tension of Yarn at Running for Rewinding (gram)*1 |
|---|---|
| Yarn not processed | 10.6 |
| Yarn processed with*2 Conventional Wax | 7.5 |
| (Amount deposited on Yarn: % by weight) | (0.3) |
| Yarn processed by Present Invention | 3.4 |
| (Amount deposited on Yarn: % by weight) | (0.2) |

*1,*2Same as described in Table 3.

EXAMPLE 7

One kilogram of polyacrylic spun knitting yarns (30/S) which had been wound on cones were placed in a can member as used in Example 1, and the pressure of the can member was reduced to 30 mmHg. Then, a dispersion composition of a sublimable substance (prepared by emulsifying a mixture of 5 grams of endo-trimethylenenorbornane and 3 grams of polyoxyethylene cetyl ether in 100 ml of heated water) was heated to 150° C. and injected into the can member. While maintaining the temperature in the can member at 50° C., the yarns were treated with the dispersion composition for 20 minutes. After cooling, the yarns were taken out of the can member.

The amount of the endo-trimethylenenorbornane deposited on the yarns and the tension of the thus-processed yarn at running were measured. The results are shown in Table 5.

TABLE 5

| | Tension of Yarn at Running for Rewinding (gram)*1 |
|---|---|
| Yarn not processed | 16.3 |
| Yarn processed with Conventional Wax*2 | 7.6 |
| (Amount deposited on Yarn: % by weight) | (0.6) |
| Yarn processed by Present Invention | 4.7 |
| (Amount deposited on Yarns: % by weight) | (0.3) |

*1,*2Same as described in Table 3.

EXAMPLE 8

One hundred kilograms of reeled thread cotton spun knitting yarns (40S) were placed in an Obameyer dyeing machine, and boiled and scoured for 60 minutes in a bath of an aqueous solution which had been prepared by dissolving 3 kilograms of caustic soda (30% by weight) and 3 kilograms of soda ash in such a manner that the liquor ratio was 1:15. After washing with water, the yarns were bleached by boiling for 60 minutes in an aqueous solution of 5 kilograms of hydrogen peroxide (35% by weight) and 3 kilograms of sodium silicate.

Thereafter, the yarns were washed with water and dyed for 60 minutes in a bath comprising 2 kilograms of Michaleon Orange 2 RS (trade name), 20 grams per liter of soda ash and 50 grams per liter of Glauber's salt under the conditions of a liquor ratio of 1:15 and a temperature of 40° C. The yarns were then treated with a processing solution containing a sublimable substance (whose formulation is shown below) at ordinary temperature for 20 minutes in an Obameyer dyeing machine, dehydrated by the use of a centrifugal dehydrator and dried at 40° to 60° C. for 60 minutes. The tension of the thus-processed yarn at running was measured, and the results are shown in Table 6.

| Formulation of Processing Solution | Parts by weight |
|---|---|
| Endo-trimethylenenorbornane | 8 |
| Sodium Alkylbenzene Sulfonate | 2 |
| Water | 900 |
| (mixed using hot water maintained at 80° C.). | |

COMPARATIVE EXAMPLE 1

The procedure of Example 8 was repeated except that a dispersion comprising 7 parts by weight of paraffin, 1 part by weight of carnauba wax, 2 parts by weight of sodium alkylbenzene sulfonate and 900 parts by weight of water was used as the processing solution. The results are shown in Table 6.

EXAMPLE 9

Ten kilograms of polyacryl spun knitting yarns (30S) were placed in a rotary pack dyeing machine and washed in a bath of 2 grams per liter of polyoxyethylene nonylphenyl ether under the conditions of a liquor ratio of 1:50 and a temperature of 60° C. for 20 minutes to thereby remove impurities. After washing with water, 200 grams of Sumi Acryl Red 5B (trade name) was added and boiled to dye the yarns.

After gradual cooling to 60° C., an emulsion prepared by emulsifying a mixture of 2 parts by weight of polyoxyethylene nonylphenyl ether and 1 part by weight of dimethyl laurylbenzyl ammonium chloride in 100 parts by weight of heated water was introduced into the foregoing dyeing machine, and the yarns were processed at 60° C. for 20 minutes. Thereafter, the yarns were taken out of the machine, dehydrated by the use of a centrifugal dehydrator, and dried at about 60° C. for 60 minutes. The tension of the thus-processed yarn at running was measured, and the results are shown in Table 6.

Comparative Example 2

The procedure of Example 9 was repeated except that the same paraffin-based processing solution as used in Comparative Example 1 was used as the processing solution. The results are shown in Table 6.

EXAMPLE 10

Ten kilograms of polyester/cotton (50:50) mixed knitting yarns (40/S) were placed in an Obameyer dyeing machine and scoured for 60 minutes in a boiling bath of an aqueous solution which had been prepared by dissolving a mixture of 500 grams of soda ash, 100 grams of caustic soda and 200 grams of sodium alkylbenzene sulfonate (50% by weight) in such a manner that the liquor ratio was 1:20. The yarns were washed with water and bleached in a boiling bath comprising 500 grams of hydrogen peroxide (35% by weight), 300 grams of sodium silicate and 20 grams of an ethylenediamine tetraacetate tetrasodium salt for 20 minutes. Then, after washing the yarns with water, 600 grams of Sumicaron Black S-B1 (trade name) was added and boiled at 130° C. for 60 minutes to thereby dye the polyester side of the yarns. The yarns were again washed with water and reduction-cleaned in a bath comprising 2 grams per liter of caustic soda and 2 grams per liter of concentrated hydrosulfide maintained at 80° C. for 20 minutes to thereby remove dyes attaching to the cotton side of the yarns and onto the surface of the polyester. After water-washing, the yarns were placed in an Obameyer dyeing machine and dyed at a liquor ratio of 1:20 for 90 minutes in a boiling aqueous solution which had been prepared by adding heated water to 600 grams of Chayazol Black B 600 (trade name) and 600 grams of sodium sulfide in an amount of 5 times that of the dye and then by reducing on heating. Thereafter, the yarns were washed with water and subjected to oxidation treatment in a bath (50° C.) containing 2 grams per liter of hydrogen peroxide (35% by weight) and 1 gram per liter of acetic acid (90%). Thus, the yarns dyed in a predetermined color were obtained.

Then, 7 parts by weight of endo-trimethylenenorbornane and 3 parts by weight of polyoxyethyleneoctyl phenol were mixed by heating and dispersed in 100 parts by weight of heated water to prepare a lubrication processing agent. The thus-obtained lubrication processing agent was introduced into the foregoing dyeing machine wherein the yarns were subjected to a lubrication processing at 40° C. for 10 minutes and then dehydrated and dried. The tension of the thus-processed yarn at running was measured, and the results are shown in Table 6. The sublimation fastness was measured, and the results are shown in Table 7.

COMPARATIVE EXAMPLE 3

The procedure of Example 10 was repeated except that the same paraffin-based processing solution as used in Comparative Example 1 was used as the processing solution. The results are shown in Table 6. The test results with respect to the sublimation fastness are shown in Table 7.

TABLE 6

| Tension of Yarn at Running for Rewinding (gram) | | | | | |
|---|---|---|---|---|---|
| Original Yarn | 16.3 | Original Yarn | 11.8 | Original Yarn | 13.8 |
| Example 8 | 4.5 | Example 9 | 2.5 | Example 10 | 3.5 |
| Comparative Example 1 | 8.9 | Comparative Example 2 | 8.6 | Comparative Example 3 | 7.6 |

Conditions for measurement of tension:

| | |
|---|---|
| Testing machine | TENSTER-D |
| Running rate of test piece | 200 m/min |
| Disc tension | 30 grams washer |
| Fullscale | 25 grams |

TABLE 7

| Sublimation Fastness (rating) | |
|---|---|
| Original yarn | 4–5 |
| Example 10 | 4–5 |
| Comparative | 2–3 |

TABLE 7-continued

| Example 3 | |
|---|---|
| Sublimation fastness test: | |
| Testing machine | Scorch tester |
| Temperature | 200° C. |
| Time | 90 seconds |

EXAMPLE 11

In this example, the sizing and lubrication processing of yarns for cotton fabrics were performed at the same time. In a sizing solution (40° C.) having the formulation as shown below was soaked 4.5 kilograms of cotton warp yarns (No. 40 count cotton yarn) for 2 minutes, and the yarns were dehydrated by the use of a dehydrator and dried at 40° to 60° C.

The physical properties of the thus-obtained yarns are shown in Table 8.

| Composition of Sizing Solution (parts by weight) | No. 1 | No. 2 | No. 3 |
|---|---|---|---|
| Corn Starch | 80 | 80 | 80 |
| Polyvinyl Alcohol | 30 | 30 | 30 |
| Paraffin (135° F.) | — | 8 | — |
| Polyoxyethylene Lauryl Ether | — | 2 | — |
| Endo-trimethylenenorbornane | — | — | 8 |
| Polyoxymethylene Lauryl Ether | — | — | 2 |
| Water | 890 | 880 | 880 |

TABLE 8

| Sample | Strength (gram) | Elongation(%) | Cohesion strength (times) | Sizing Ratio (%) | Cohesion Strength/ Sizing Ratio |
|---|---|---|---|---|---|
| Original Yarn | 139.6 | 2.5 | 719 | — | — |
| No. 1 | 262.3 | 1.8 | 2039 | 11.3 | 180.4 |
| No. 2 | 224.1 | 2.3 | 1480 | 10.2 | 145.1 |
| No. 3 | 258.6 | 2.0 | 1963 | 10.9 | 190.6 |

Strength and elongation: Measured using a Shoper strong elongation testing machine.

Cohesion strength: Measured using a TM type cohesion strength testing machine.

Sizing ratio: Measured using a vacuum infrared dry measuring apparatus (desizing agent: Biotex S (trade name), iodo reaction indicator).

The friction test for the sized yarns was conducted by dry braid, and the results (number of cutting of yarns) are shown in Table 9.

TABLE 9

| Sample | Number of Dry Braid 500 to 700 | 700 to 900 | 900 to 1,500 | Number of cutting of Warp Yarns | Formation of Fluff |
|---|---|---|---|---|---|
| No. 1 | 0 | 3 | 16 | 19 | 26 |
| No. 2 | 0 | 0 | 8 | 8 | 3 |
| No. 3 | 0 | 0 | 1 | 1 | 1 |

EXAMPLE 12

Cotton warp yarns (No. 40 count cotton yarn) was soaked in a sizing solution containing 1.2% by weight of Poval (degree of polymerization, a partially saponified product) and 6.2% by weight of corn starch and having a viscosity (VIS CUP) of 20 seconds, which was maintained at 95° C., to thereby obtain the sized yarns having a sizing ratio of 6.5% by weight.

A lubrication processing solution was prepared by mixing 80 parts by weight of endo-trimethylenenorbornane and 20 parts by weight of polyoxyethylene octyl ether by heating, emulsifying or dispersing the resulting mixture in 500 parts by weight of heated water, and furthermore by adding thereto 400 parts by weight of water. The thus-obtained processing solution was sprayed on the foregoing warp and deposited thereon in an amount of 3% by weight.

The thus-obtained yarns for fabrics were woven and the number of cutting of warp was measured. The results are shown in Table 10 along with the results for silicone-processed yarns.

TABLE 10

| Yards | Original Yarns | Silicone-processed Yarns* | Yarns processed by Present Invention |
|---|---|---|---|
| 0 to 20 | 7 | 3 | 2 |
| 21 to 40 | 14 | 4 | 3 |
| 41 to 60 | 16 | 3 | 0 |
| 61 to 80 | 9 | 0 | 1 |
| 81 to 95 | 5 | 3 | 2 |
| Total | 51 | 13 | 8 |

*Warp with Shinetsu Silicone KM-781 (produced by Shinetsu Chemical Industry Co., Ltd.; 30% emulsion) deposited thereon in an amount of 1%.

The thus-obtained fabric was soaked in a mixed solution of 0.1 gram of Seres Blue GN, 400 milliliters of isopropyl alcohol and 600 milliliters of water at ordinary temperature for 30 seconds to remove oily materials therefrom, and then it was washed with water and its degree of coloration was measured. The results are shown in Table 11.

TABLE 11

| | Original Yarn | Yarn processed with silicone | Yarn processed by present invention |
|---|---|---|---|
| Degree of Coloration (rating)* | 3-4 | 1-2 | 3-4 |

*JIS Specification, gray scale.

It can be seen from Table 11 that when the fabrics produced from the yarns subjected to the present treatment are allowed to stand, the processing solution is sublimated and there is no residual processing solution on the fabrics.

EXAMPLE 13

One kilogram of polypropylene cotton was soaked in an aqueous dispersion containing 1% of adamantane and 0.05% of polyethylene glycol mono-p-nonylphenyl ether (adduction amount of ethylene oxide: 10 mol) maintained at 50° C., for 10 minutes. Then, the polypropylene cotton was taken out, dehydrated at a dehydration ratio of 50%, and allowed to dry. Using the thus-processed cotton, a nonwoven fabric carpet was produced.

On the surface of the thus-obtained nonwoven fabric carpet, an aqueous dispersion containing 5% of a fluorine resin emulsion (trade name: Asahi Guarde AG-800; produced by Asahi Glass Co., Ltd.) was sprayed in a coating amount of 250 g/m$^2$ and dried at 120° C. for 5 minutes. The water-repellency and oil-repellency of the nonwoven fabric carpet were as follows:

Water-repellency: Even after 5 minutes, no water droplets disappeared.

Oil-repellency: 6

Comparative Example 4

One kilogram of polypropylene cotton was soaked in an aqueous dispersion containing 1% of dimethyl polysiloxane type silicone oil and 0.05% of oleyl alcohol (adduction amount of ethylene oxide: 5 mol), maintained at 50° C., for 10 minutes, and thereafter was dehydrated and dried in the same manner as in Example 1. Using the thus-processed cotton, a nonwoven fabric carpet was produced.

The thus-obtained nonwoven carpet was then subjected to the same fluorine compound processing as in Example 13. The water-repellency and oil-repellency of the nonwoven fabric carpet were as follows:

Water-repellency: Within 1 second, water droplets disappeared.

Oil-repellency: 0

The nonwoven fabric carpets obtained in Example 13 and Comparative Example 4 were each bonded to a floor, and a treading test with shoes was performed for one month. Observation of the nonwoven fabric carpet with naked eye showed that the staining of the nonwoven fabric carpet of Comparative Example 4 was great and prominent, whereas for the nonwoven fabric carpet of Example 13, the staining was very limited.

EXAMPLE 14

Fourteen hundred grams of nylon spun knitting yarns which had been wound on cones were placed in a can member as used in Example 1, and the pressure of the can member was reduced to 12 mmHg. Then, heated water maintained at 150° C. and 140 g of endo-trimethylenenorbornane heated to 90° C. were injected into the can member. By maintaining the can member at 50° C. for 10 minutes, endo-trimethylenenorbornane was deposited on the yarns. After cooling, the yarns were taken out. The amount of the endo-trimethylenenorbornane deposited on the yarn was 0.2%.

The thus-processed yarns were knitted. The surface of the knitted fabrics thus obtained was soaked in an aqueous dispersion containing 3% of a fluorine resin emulsion (trade name: Asahi Guarde AG-710, produced by Asahi Glass Co., Ltd.), and it was then squeezed at a squeezing ratio of 90% using a Patting Mangle and dried at 100° C. Thereafter, the knitted fabrics were subjected to heat treatment at 170° C. for 1 minute. The water-repellency and oil-repellency of the knitted fabrics were as follows:

Water-repellency: Even after 100 minutes, no water droplets disappeared.

Oil-repellency: 7

Comparative Example 5

Fourteen hundred grams of nylon spun knitting yarns which had been wound on cones were soaked in an aqueous dispersion containing 5% of a coil-feeding lubricant consisting of spindle oil (2) and oleic acid (8) and 0.5% of oleyl alcohol (adduction amount of ethylene oxide: 5 mol), maintained at 50° C., for 10 minutes, dehydrated and dried. The amount of the lubricant deposited on the yarns was 0.2%.

The thus-processed yarns were knitted, and the fabrics thus obtained was subjected to the same fluorine compound processing as in Example 14. The water-repellency and oil-repellency of the fabrics were as follows:

Water-repellency: In 50 minutes, all water droplets disappeared.

Oil-repellency: 1

EXAMPLE 15

One kilogram of cotton spun yarns were soaked in a solution containing 1% of endo-trimethylenenorbornane, 3% of a solvent type fluorine resin (trade name: Asahi Guarde AG-650, produced by Asahi Glass Co., Ltd.) and 97% of 1,1,1-trichloroethane for 5 minutes, taken out, dehydrated at a dehydration ratio of 100%, allowed to dry, and then knitted. They showed good knitting properties.

Subsequently, the knitted fabrics were subjected to heat treatment at 130° C. for 5 minutes. The water repellency and oil-repellency of the knitted fabrics were as follows:

Water-repellency: Even after 100 minutes, no water droplets disappeared.

Oil-repellency: 6

COMPARATIVE EXAMPLE 6

One kilogram of cotton spun yarns were soaked in a solution containing 3% of solid paraffin, 1% of carnauba wax, 3% of a solvent type fluorine resin (trade name: Asahi Guarde AG-650; produced by Asahi Glass Co., Ltd.) and 97% of 1,1,1-trichloroethane for 5 minutes, and thereafter they were dehydrated, allowed to dry and then knitted in the same manner as in Example 1.

Thereafter, the knitted fabrics thus obtained were subjected to the same heat treatment as in Example 15. The water-repellency and oil-repellency of the knitted fabrics were as follows:

Water-repellency: Immediately, water droplets disappeared (0 second).

Oil-repellency: 1

EXAMPLE 16

One kilogram of polyester stretched yarns were soaked in an aqueous dispersion containing 2% of cyclododecane and 0.1% of lauryl alcohol (adduction amount of ethylene oxide: 6 mol %), maintained at 50° C., for 10 minutes, taken out thereof, dehydrated at a dehydration ratio of 80%, and allowed to dry. The thus-processed yarns were woven. The woven fabrics thus obtained were soaked in an aqueous dispersion containing 3% of a fluorine resin emulsion (trade name: Asahi Guarde AG-710; produced by Asahi Glass Co., Ltd.), squeezed at a squeezing ratio of 80% using a Patting Mangle, and dried at 100° C. for 3 minutes. Then, the woven fabrics were subjected to heat-treatment at 170° C. for 1 minute. The water-repellency and oil-repellency of the woven fabrics were as follows:

Water-repellency: Even after 100 minutes, no water droplets disappeared.

Oil-repellency: 7

COMPARATIVE EXAMPLE 7

One kilogram of polyester stretched yarns were soaked in an aqueous dispersion containing 2% of Japan wax and 0.2% of nonylphenol (adduction amount of ethylene oxide: 10 mol %), maintained at 50° C., for 10 minutes, taken out therefrom, dehydrated at a dehydration ratio of 80%, and allowed to dry. The thus-obtained fabrics were subjected to the same fluorine compound-processing as in Example 16. The water-repellency and oil-repellency of the fabrics were as follows:

Water-repellency: Immediately, water droplets disappeared (0 second).

Oil-repellency: 0

In the present invention, trimethylenenorbornane means 1,7,7-trimethylnorbornane (i.e. 1,7,7-trimethylbicyclo [2,2,1]heptane). Cationic surfactants can also be used. Suitable examples of cationic surfactants include lauryl trimethyl ammonium chloride, stearyl dimethyl benzyl ammonium chloride, polyethylene glycol stearyl amine, trimethyl octadecyl ammonium chloride, palmityl dimethyl benzyl ammonium chloride, lauryl pyridinium chloride, etc.

We claim:

1. A method of treating fibers to lubricate the surface thereof comprising depositing between 0.005% and 5% by weight based on the weight of the fibers of at least one sublimable compound selected from the group consisting of endo-trimethylenenorbornane trimethylnorbornane, and cyclododecane from the gas phase on said fibers to impart lubricity to said fibers.

2. The method of claim 1 wherein said at least one sublimable compound is placed in a vessel together with said fiber and heated to cause said at least one sublimable compound to evaporate and form a gas which condenses on said fibers.

3. The method of claim 1 wherein said at least one sublimable compound is placed in a vessel together with said fibers and the pressure is reduced in said vessel thereby causing said at least one sublimable compound to become a gas which condenses on said fibers.

4. The method of claim 1 wherein said sublimable substance is endo-trimethylenenorbornane.

5. The method of claim 1 wherein said sublimable substance is trimethylnorbornane.

6. The method of claim 1 wherein said sublimable substance is cyclododecane.

7. Yarn composed of fibers and containing between about 0.005 and 5% by weight based on the fibers of at least one sublimable compound selected from the group consisting of endo-trimethylenenorbornane, trimethylnorbornane and cyclododecane, said sublimable compound having been condensed in said fibers from the gas phase and imparting lubricity to said fibers.

8. The yarn of claim 7 containing between about 0.01 and 3% of said sublimable compound.

9. The yarn of claim 7 containing between about 0.01 and 2% of said sublimable compound.

10. The yarn of claim 7 containing between about 0.03 and 3% of said sublimable compound.

11. The yarn of any one of claims 7, 8, 9 or 10 wherein said sublimable compound is endo-trimethylenenorbornane.

12. The yarn of any one of claims 7, 8, 9 or 10 wherein said sublimable compound is trimethylnorbornane.

13. The yarn of any one of claims 7, 8, 9 or 10 wherein said sublimable compound is cyclododecane.

* * * * *